US006973690B2

(12) United States Patent
Muci et al.

(10) Patent No.: US 6,973,690 B2
(45) Date of Patent: Dec. 13, 2005

(54) ADJUSTABLE INFLATABLE PILLOW

(75) Inventors: Francisco J. Muci, Palatine, IL (US); Karen L. Boso, Woodstock, IL (US); Chen Ching-Chin, Taipei (TW)

(73) Assignee: Aero Products International, Inc., Wauconda, IL (US)

( * ) Notice: Subject to any disclaimer, the term of this patent is extended or adjusted under 35 U.S.C. 154(b) by 502 days.

(21) Appl. No.: 10/196,887

(22) Filed: Jul. 17, 2002

(65) Prior Publication Data

US 2004/0010853 A1 Jan. 22, 2004

(51) Int. Cl.[7] ..... A47G 9/00
(52) U.S. Cl. ..... 5/644; 5/655.3; 5/712
(58) Field of Search ..... 5/644, 654, 655.3, 5/706, 710, 711, 712, 713, 932

(56) References Cited

U.S. PATENT DOCUMENTS

| | | | | | |
|---|---|---|---|---|---|
| 2,575,764 | A | * | 11/1951 | Morner | 428/72 |
| 2,614,272 | A | * | 10/1952 | Morner | 5/655.3 |
| 2,703,770 | A | * | 3/1955 | Melzer | 5/710 |
| 3,008,214 | A | * | 11/1961 | Foster et al. | 428/12 |
| 5,044,030 | A | * | 9/1991 | Balaton | 5/712 X |
| 5,163,196 | A | | 11/1992 | Graebe et al. | 5/654 |
| 5,619,764 | A | * | 4/1997 | Lopau | 5/713 |
| 5,638,565 | A | * | 6/1997 | Pekar | 5/710 |
| 5,689,845 | A | | 11/1997 | Sobieralski | 5/654 |
| 5,708,999 | A | | 1/1998 | Priolo et al. | 5/644 |
| 5,727,270 | A | * | 3/1998 | Cope et al. | 5/710 |
| 5,845,352 | A | | 12/1998 | Matsler et al. | 5/654 |
| 5,902,011 | A | * | 5/1999 | Hand et al. | 5/644 X |
| 6,131,219 | A | | 10/2000 | Roberts | 5/644 |
| 6,189,168 | B1 | | 2/2001 | Graebe | 5/644 |
| 6,546,580 | B2 | * | 4/2003 | Shimada | 5/710 |
| 6,671,910 | B2 | * | 1/2004 | Hsu et al. | 5/710 |
| 2002/0050010 | A1 | * | 5/2002 | Shimada | 5/706 |
| 2003/0024050 | A1 | * | 2/2003 | Boso et al. | 5/711 |
| 2003/0101516 | A1 | * | 6/2003 | Hsu et al. | 5/710 |
| 2003/0200610 | A1 | * | 10/2003 | Wang | 5/710 |
| 2004/0010853 | A1 | * | 1/2004 | Muci et al. | 5/644 |

FOREIGN PATENT DOCUMENTS

| | | |
|---|---|---|
| DE | 94 10 150 | 10/1994 |
| EP | 0 736 278 A1 | 10/1996 |
| FR | 1 414 938 A | 10/1965 |
| GB | 1 035 490 A | 7/1966 |

OTHER PUBLICATIONS

International Search Report From Corresponding PCT International Application No. PCT/US03/22508, Dated Nov. 11, 2003, 5 pages.

* cited by examiner

*Primary Examiner*—Robert G. Santos
(74) *Attorney, Agent, or Firm*—Brinks Hofer Gilson & Lione

(57) ABSTRACT

An inflatable pillow comprising a first layer comprising a top sheet of material and a bottom sheet of material welded together so as to form a plurality of chambers in fluid communication with each other. A second layer comprising a top sheet of material and a bottom sheet of material are also welded together so as to form a plurality of chambers in fluid communication with each other. The first and the second layers are welded together such that the first and the second layers are in fluid communication with each other at one or more openings in the first and the second layers.

30 Claims, 4 Drawing Sheets

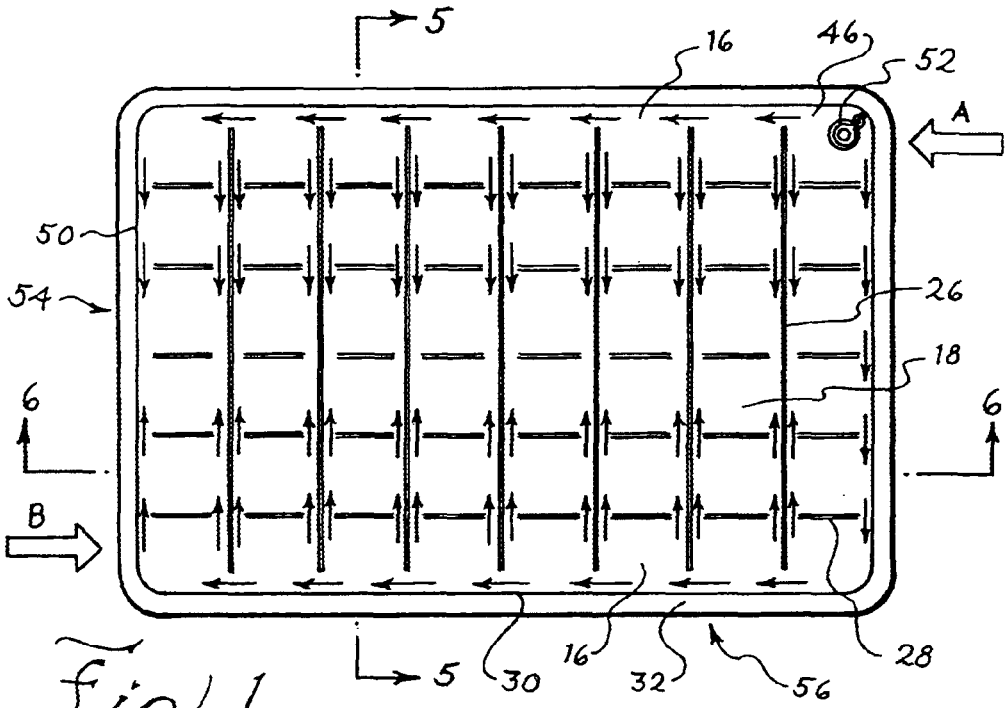
Fig. 1
Fig. 2
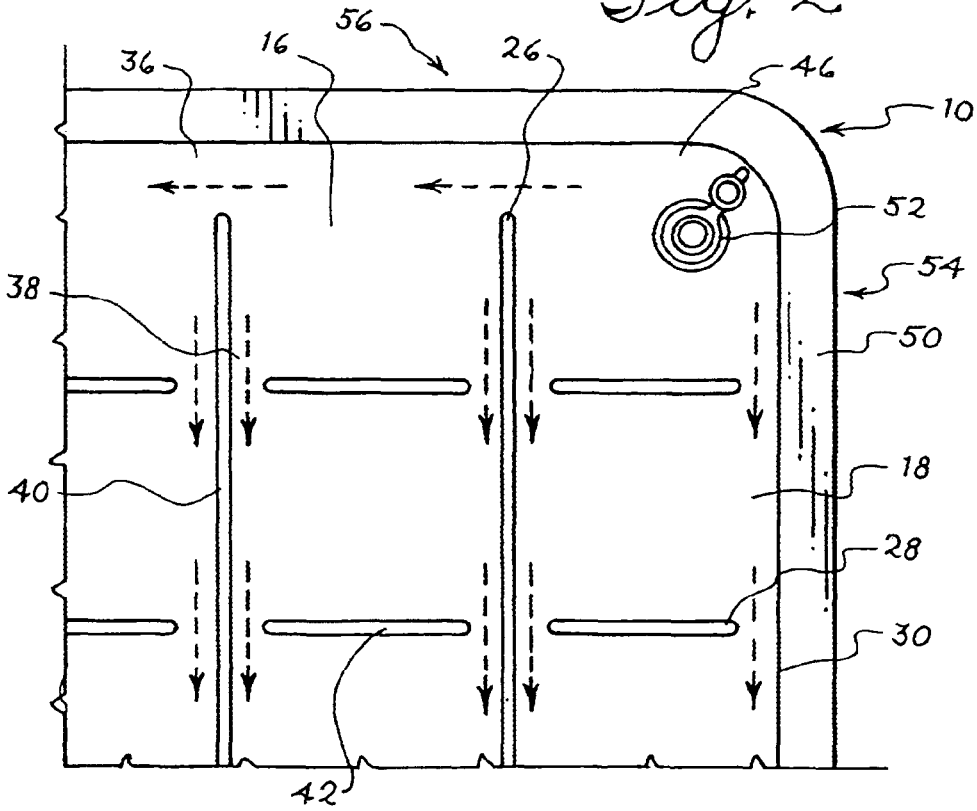

ADJUSTABLE INFLATABLE PILLOW

FIELD OF THE INVENTION

The invention relates generally to the field of inflatable objects. In particular, the present invention relates to an inflatable pillow that is adjustable.

BACKGROUND OF THE INVENTION

There are many different types of pillows on the market today. Some offer varying levels of cervical support, and many are made from state of the art materials that offer improved support characteristics.

Often, people prefer differing levels of pillow firmness at different times. Some prefer a relatively firm pillow over a soft pillow. Most pillows made of conventional materials offer a firmness characteristic that cannot be changed; in other words, there is typically no way to adjust a pillow to another user's preferences. Instead, the user is forced to purchase another pillow having different firmness characteristics. The need for adjustability spawned the field of adjustable pillows, commonly filled with air.

An air-filled pillow can be adjusted by the individual user to varying levels of firmness for a customized and comfortable firmness configuration. For example, a person that sleeps on their back may prefer a pillow of medium firmness, while a person that sleeps on their side should utilize a firm pillow for proper neck support. Inflatable pillows have even been formed with special sections that provide extra cervical support. These pillows have an extra chamber that can be separately inflated to a different level of firmness than the main pillow chamber. Inflatable pillows also have the advantage of being easy to transport, since they are relatively compact when deflated.

Although inflatable pillows available today can provide adjustable firmness, it is desirable to further improve the comfort of inflatable pillows, while still allowing them to be easily transportable and easy to inflate.

BRIEF SUMMARY OF THE INVENTION

In accordance with the present invention, an inflatable pillow is provided having improved firmness properties. The pillow provides improved support to the user and allows for a wider range of inflatability and support options.

In one aspect of the present invention, an inflatable pillow is provided comprising a first layer comprising a top sheet of material and a bottom sheet of material. The top sheet and bottom sheet of material are welded together so as to form a plurality of chambers in fluid communication with each other. A second layer comprising a top sheet of material and a bottom sheet of material are also welded together so as to form a plurality of chambers in fluid communication with each other. The first and the second layers are welded together such that the first and the second layers are in fluid communication with each other at one or more openings in the first and the second layers.

In another aspect of the present invention, an inflatable pillow comprises a first layer comprised of a first and a second sheet of material each having a generally rectangular shape. The first and the second sheets of material have a plurality of large parallel welds connecting the first and second layers of material, with the large welds extending nearly to the sides of the first and the second sheets of material so as to leave an opening along each side of the first and the second sheets of material. The first and the second sheets of material also have a plurality of small parallel welds arranged perpendicular to the large welds, the small welds arranged so as to form generally evenly spaced chambers in fluid communication with each other. The chambers have sealed walls formed by the large welds and open walls formed by the small welds, the open walls having openings to the adjacent chamber at a first end and a second end. The pillow includes a second layer comprised of a first and a second sheet of material having a chamber structure similar to that of the first layer in this embodiment.

In yet another aspect of the invention, the inflatable pillow comprises a first layer of chambers formed from two generally rectangular layers of material welded together along an outer edge. The first layer of chambers includes chambers that are fluidly connected to each other, defined by a plurality of large parallel welds connecting the two layers and a plurality of small parallel welds connecting the two layers. The small parallel welds are defined perpendicular to the large parallel welds. The pillow includes a second layer of chambers formed from two layers of material welded together along an outer edge. The second layer of chambers includes chambers fluidly connected to each other, defined by a plurality of large parallel welds connecting the two layers of material and a plurality of small parallel welds connecting the two layers. The small parallel welds are defined perpendicular to the large parallel welds.

BRIEF DESCRIPTION OF SEVERAL VIEWS OF THE DRAWINGS

FIG. 1 is a top plan view of an uninflated embodiment of the present invention;

FIG. 2 is a close-up view of the embodiment shown in FIG. 1;

DETAILED DESCRIPTION OF THE INVENTION

Figure 3:
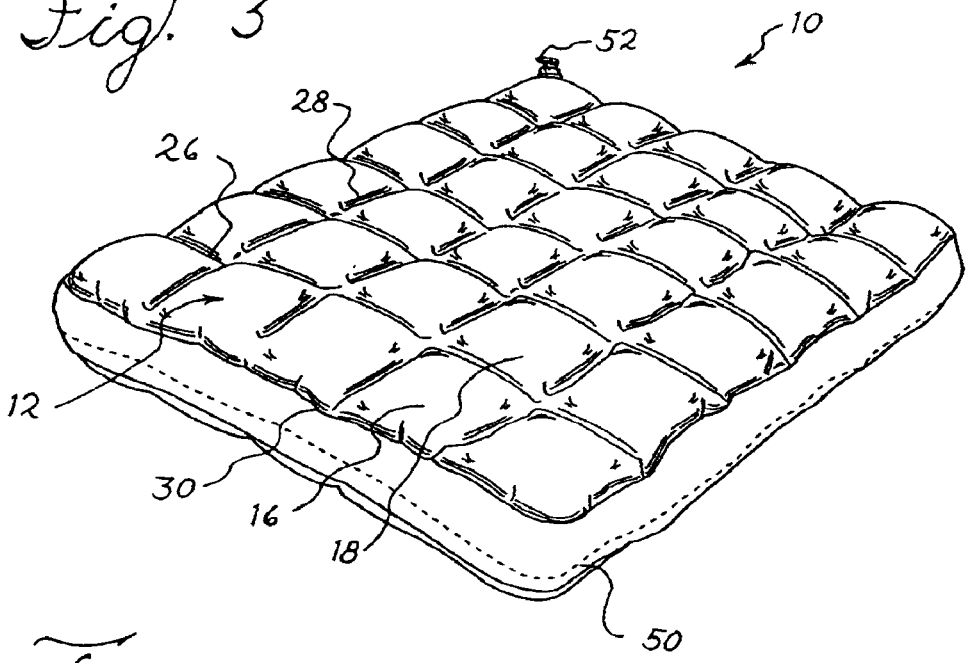
FIG. 3 is a perspective view of the embodiment of the present invention showing in FIG. 1 and inflated.
Figure 4:
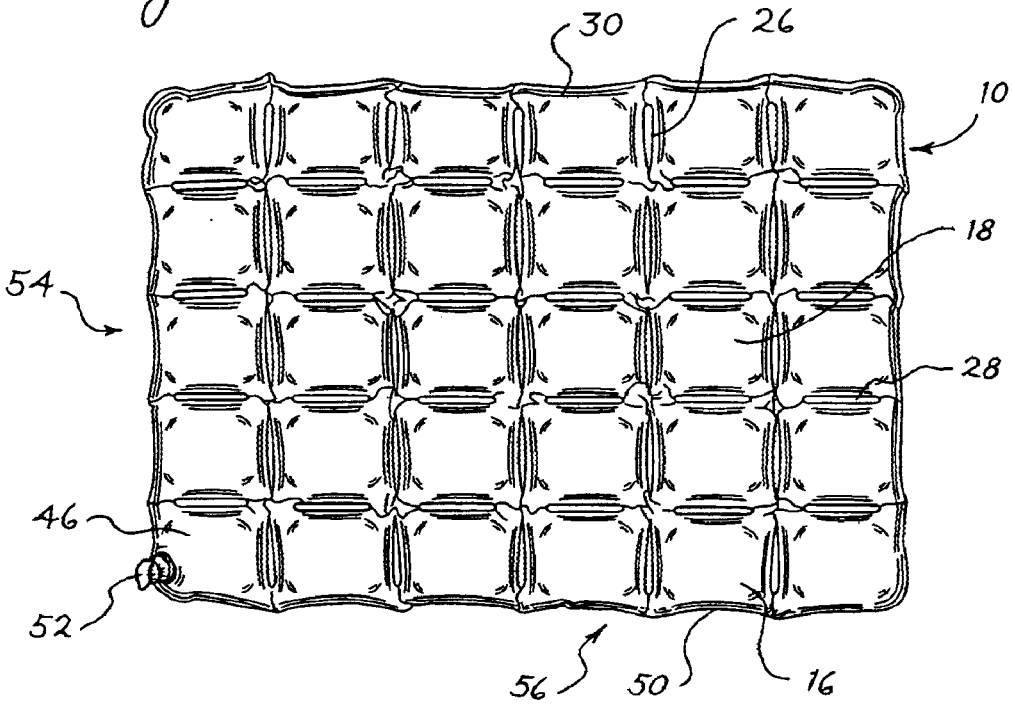
FIG. 4 is a top plan view of the embodiment of the present invention showing in FIG. 1 and inflated.
Figure 5:
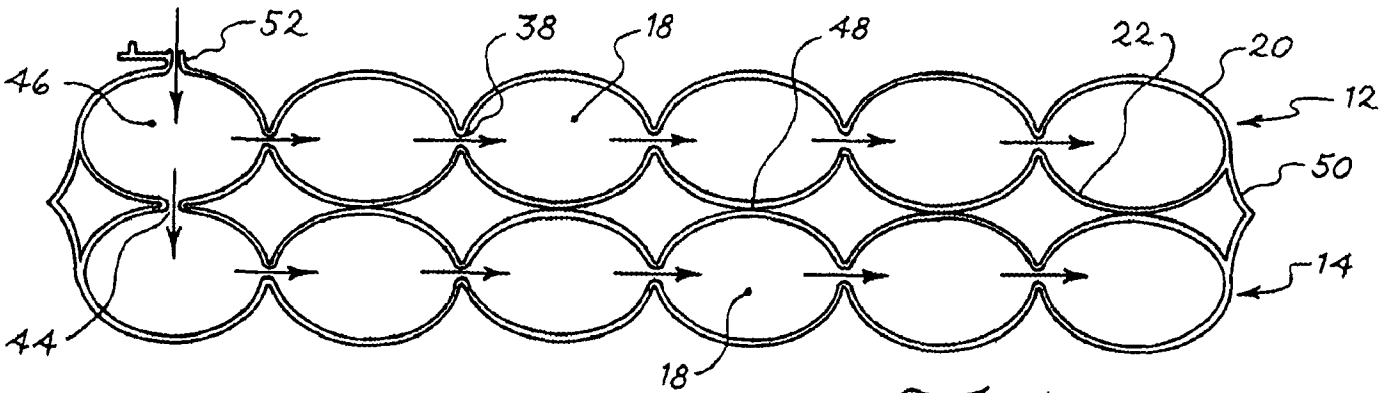
FIG. 5 is a cross-sectional view along line 5—5 of FIG. 1.
Figure 6:
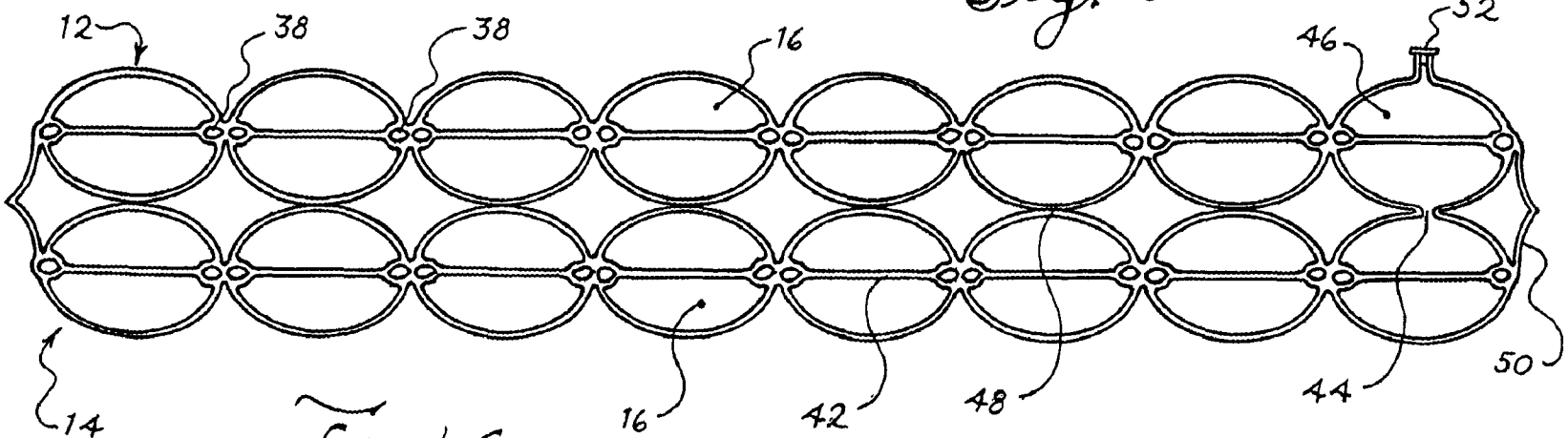
FIG. 6 is a cross-sectional view along line 6—6 of FIG. 1.
Figure 7:
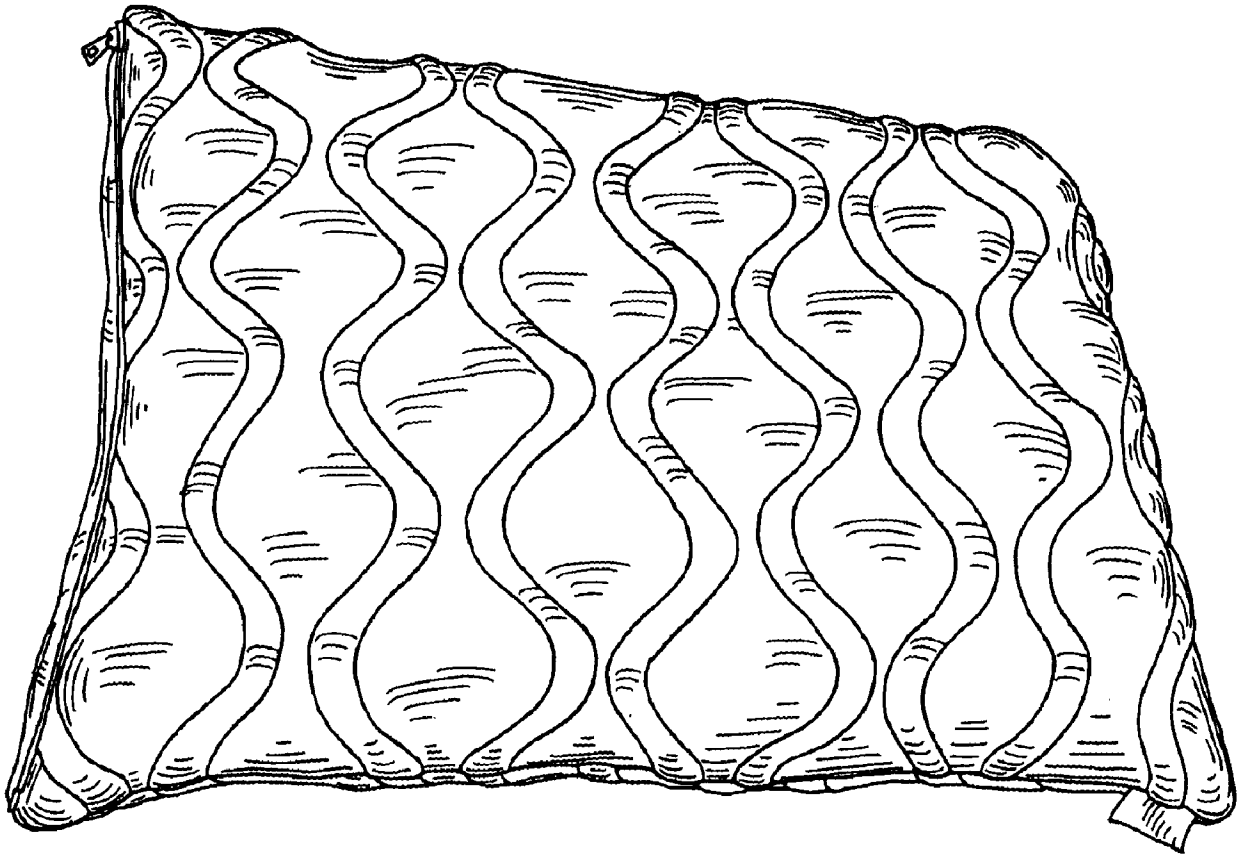
FIG. 7 is a perspective view of an embodiment of the present invention with a cover in place.

Referring in combination to FIGS. 1–6, a preferred embodiment of the present invention is shown. As shown in FIGS. 5 and 6, the inflatable pillow 10 of the present invention is preferably formed from at least two layers 12, 14 of chambers designated by reference numerals 16, 18. The designations for the chambers refer to two different types of chambers that will be described in more detail below. A first layer 12 of chambers 16, 18 is preferably made up of a first 20 and a second 22 layer of material. The material is preferably a flexible vinyl material, such as PVC. Flexible materials other than PVC also may be utilized to form the present invention. The first 20 and the second 22 layers of material are preferably rectangular in shape, as in a conventional pillow. This allows the inflatable pillow 10 of the present invention to fit in a conventional pillow case 24, as is shown in FIG. 7. Although the pillow 10 of the present invention is illustrated as rectangular in shape, an inflatable pillow according to the present invention could be designed to take other shapes as needed for the particular use.

The present invention preferably includes a first layer 12 comprising a plurality of chambers 16, 18 formed from the first 20 and the second 22 layers of material. These chambers 16, 18 are preferably in fluid communication with each other to allow air to pass from chamber to chamber upon inflation. The chambers 16, 18 of the present invention are preferably formed by a plurality of welds 26, 28 that attach the first 20 and second 22 layers of material together in an airtight manner. The first 20 and the second 22 layers preferably have a third type of weld to assist in holding the two layers 20, 22 together and to keep the chambers 16, 18 airtight. This third weld 30 is preferably located around the outer edge 32 of the first 20 and the second 22 layers and continues around the entire outer edge 32 of the first 20 and the second layers 22. The third weld 30 preferably closely follows the general shape of the pillow 10, forming an airtight external seal between the first 20 and the second 22 layers.

There are preferably two other types of welds. The welds of the present invention can be seen most clearly in FIGS. 1 and 2. Large welds 26 of the present invention are spaced generally equally across the surface of the inflatable pillow 10. The large welds 26 of the present invention preferably extend nearly to the sides of the first 20 and second 22 layers of material, leaving spaces 36 for air to flow between chambers 16 near the sides of the first 20 and second 22 layers of material. These large welds 26 are preferably parallel to each other.

The second type of welds are preferably small welds 28 in comparison to the large welds 26. The small welds 28 in the preferred embodiment are preferably evenly spaced apart, and are arranged perpendicular to the large welds 26 and parallel to each other. As shown in the Figures, the large 26 and small 28 welds preferably form generally square-shaped chambers 16, 18 in the first 20 and second 22 layers of material when the pillow 10 is deflated. The small welds 28 are preferably positioned such that two openings 38 are present to provide fluid communication between the chambers 16, 18. For each chamber 18, the large welds 26 form an elongated sealed wall 40 and the small welds 28 form a shorter, open wall 42. This arrangement of large 26 and small 28 welds allows air to flow between the chambers 16, 18 in a controlled manner, resulting in more consistent air support throughout the pillow 10 when the user shifts position. In the embodiment shown in the Figures, there are seven large welds 26 and forty small welds 28, thus creating forty-eight chambers 16, 18 in the first layer 12. Different numbers of large welds 26, small welds 28 and chambers 16, 18 are envisioned, depending on the type and/or size of pillow 10.

The inflatable pillow 10 of the present invention also preferably has a second layer 14 of chambers 16, 18. This second layer 14 of chambers 16, 18 is shown in FIGS. 5 and 6, and is preferably positioned below the first layer 12 of chambers 16, 18. This second layer 14 of chambers 16, 18 is preferably formed in the same manner as the first layer 12 of chambers 16, 18 and is aligned with the first layer 12 of chambers 16, 18 so that the pillow 10 has a consistent shape. The first 12 and second 14 layers of the present invention are preferably in fluid communication with each other at at least one point. Preferably, the majority of the chambers 16, 18 of the first 12 and second 14 layers are sealed off from each other, preventing air from passing between them. In contrast, certain chambers 46 of the first 12 and the second 14 layers have openings 44 between them to allow air to pass from the first layer 12 to the second layer 14, and vice versa. Preferably, these openings 44 are located in the corner chambers 46 of each layer 12, 14, however, these openings 44 can be defined in other aligned chambers.

The first 12 and second 14 layers of chambers 16, 18 are preferably welded together along the outer edge 32 of the layers 12, 14 as well as in the areas 48 where the chambers 16, 18 of each layer 12, 14 come in contact with each other. Additionally, a connecting layer 50 of material can be welded around the outer edge 32 of the layers 12, 14 of chambers 16, 18 to assist the connection between the layers 12, 14. Additionally, a valve 52 is preferably defined in either the first 12 or the second 14 layer of chambers 16, 18 to allow for inflation of the pillow 10. The valve 52 can be any type of valve known in the art, and can be inflated by mouth or through mechanical means. The valve 52 is shown in a corner chamber 46 of the first layer 12 in the present embodiment, but can be located elsewhere if desired. The welds 26, 28, 30 of the present invention are preferably sonic welds, or the material can be heated and melted together to form the necessary airtight seals. Additionally, other types of sealing mechanisms that result in airtight seals can be used in the present invention.

The construction described above provides an inflatable pillow consisting of two layers 12, 14 of chambers 16, 18. This allows a user to rest his or her head on two interacting layers of air, providing extra comfort over prior art inflatable pillows. Additionally, the chambers 16, 18 are specially designed to interact with each other to allow air to flow between them in such a way that the firmness of the pillow 10 adjusts itself constantly in reaction to movement of the user's head and/or neck.

There are preferably two types of chambers 16, 18 defined in the pillow 10 of the present invention. These two types of chambers 16, 18 are formed by the large 26 and small welds 28. The first type of chamber 16 is preferably arranged along at least two outer edges 32 of the pillow 10. These chambers 16 are defined on the long sides 56 in the embodiment shown. In the Figures, these chambers are shown along lines A and B. The positioning of the first type of chambers 16 is defined by the direction of the large welds 26. The large welds 26 are preferably aligned parallel with the short sides 54 of the pillow, and the first type of chamber is preferably located along the long sides 56 of the pillow 10. This preferred orientation of the large welds 26 of the present invention leaves openings 36 between the large welds 26 and the third weld 30. This opening allows fluid communication between each first type of chamber 16 and the adjacent first type of chamber 16. The small welds 28 in each first type of chamber 16 form an open wall 42 with at least two openings 38 from each first type of chamber 16 to each second type of chamber 18.

The second type of chamber 18 is preferably defined as any chamber that is not a first type of chamber 16. As shown in the preferred embodiment in the Figures, the second type of chamber 18 is located in all interior locations as well as along the short sides 54 of the pillow 10. The difference between the first type of chamber 16 and the second type of chamber 18 is that the large welds 26 provide sealed walls 40 on opposing sides of each second type of chamber 18, while the small welds 28 provide open walls 42 on the other opposing sides. Thus, rather than having a fluid connection with every adjacent chamber 18, the second type of chamber 18 is preferably only fluidly connected with the chambers 16, 18 on two of its opposing sides.

The first 12 and second 14 layers of chambers also preferably have openings 44 between them to allow air to pass between the layers 12, 14. In the preferred embodiment shown in FIG. 5, one of these openings 44 is shown in the corner chamber 46. These openings 44 are preferably located between at least one set of corner chambers 46, but can be located between multiple corner chambers 46, or between other types of chambers 16, 18. In the preferred embodiment shown in the Figures, there is an opening 44 between the corner chambers 46 where the valve 52 is located, allowing for easy and rapid inflation of both layers 12, 14 of chambers 16, 18 at once. Alternatively, the opening 44 between the two layers 12, 14 of chambers can be eliminated entirely, and a second valve can be added to the second layer 14 of chambers so that the first 12 and second 14 layers of chambers can be inflated and adjusted individually.

This arrangement of first 16 and second 18 types of chambers allows for controlled airflow between the chambers 16, 18. The arrows in the Figures show the flow of air between the chambers 16, 18 during inflation at the valve 52. Air travels into the valve 52 and into the first 16 and second 18 types of chambers, as well as into the second layer 14 of chambers through the opening 44 between the corner chambers 46. Air travels across the first type of chamber 16, entering each second type of chamber 18 adjacent to each first type of chamber 16. Air then travels between each second type of chamber 18 until all the chambers 16, 18 are inflated in both layers 12, 14 of chambers 16, 18. The openings 36, 38 between the chambers also allow the inflatable pillow 10 of the present invention to constantly adjust in a controlled manner when different amounts of pressure are applied to certain chambers 16, 18. When pressure is applied to an individual chamber 16, 18, air will be pushed out of it and redistributed amongst the other chambers 16, 18 of the pillow 10 while still leaving enough inflated structure in individual, smaller chambers to provide support where necessary. In this manner, the pillow 10 of the present invention provides an improved support system for a user's head and neck. It is also possible to adjust the firmness of the entire pillow 10 by adding or removing air at the valve 52 when necessary.

It should be noted that there could be a wide range of changes made to the present invention without departing from its scope. As noted, a different number of chambers 16, 18 or large 26 and small 28 welds could be utilized to make a different-sized pillow 10. The ratio of large 26 to small 28 welds also could be adjusted, and the large 26 and small welds 28 could be positioned differently. For example, the large welds 26 could extend to the third weld 30 on one side of the pillow, thus creating a different flow path for the air. Similarly, the small welds 28 could extend to contact a large weld 26 on only one side of each chamber 18. This would allow air to flow between each chamber 18 through only one opening. The invention could also be created utilizing only small welds 28. If this embodiment is utilized, only the second type of chamber 18 would be present in each layer of chambers 12, 14.

Different sizes of chambers in the same pillow 10 could be utilized, for example, a layer of larger chambers 26, 28 could provide extra neck and cervical support for a user. As described, the pillow 10 could also take other shapes, such as round or square. Extra openings 44 could be provided between the layers 12, 14 of chambers, and more layers of chambers could be added to the pillow 10 itself. Additionally, the inflatable pillow of the present invention could be filled with another fluid or liquid, rather than air. Any fluidic substance could be utilized to inflate the present invention. Thus, it is intended that the foregoing detailed description be regarded as illustrative rather than limiting and that it be understood that it is the following claims, including all equivalents, which are intended to define the scope of the invention.

We claim:

1. An inflatable pillow comprising:

a first layer comprising a top sheet of material and a bottom sheet of material, said top sheet of material and said bottom sheet of material welded together so as to form a plurality of chambers in fluid communication with each other;

a second layer comprising a top sheet of material and a bottom sheet of material, said top sheet of material and said bottom sheet of material welded together utilizing at least two types of parallel welds wherein said welds are all spaced apart from one another so as to form a plurality of chambers in fluid communication with each other; and said first and said second layers being welded together such that said first and said second layers are in fluid communication with each other at one or more openings in said first and said second layers.

2. The inflatable pillow of claim 1 wherein said chambers further comprise a plurality of first chambers and second chambers.

3. The inflatable pillow of claim 2, wherein said first chambers are arranged along the outer edges of two opposing sides of said first and said second layers.

4. The inflatable pillow of claim 3, wherein said second chambers comprise all other chambers.

5. The inflatable pillow of claim 4, wherein said first chambers have at least one fluid connection between each adjacent chamber.

6. The inflatable pillow of claim 5, wherein said second chambers have at least one fluid connection between the chambers adjacent two opposite sides and are sealed off from the chambers on their other two opposite sides.

7. The inflatable pillow of claim 6, further comprising a layer of material welded along the outer edge of said first and said second layers to connect said first and said second layers.

8. The inflatable pillow of claim 7, wherein said one or more openings between said first and said second layers are defined in at least one chamber located in a corner of said first or said second layers.

9. The inflatable pillow of claim 8, further comprising a valve defined in at least one of said chambers.

10. The inflatable pillow of claim 9, wherein said valve is defined in a corner chamber.

11. The inflatable pillow of claim 10, said first and second layers being welded together along sonic welds.

12. The inflatable pillow of claim 10, said first and second layers being welded together along areas of said layers that have been melted together.

13. An inflatable pillow comprising:

a first layer, said first layer comprised of a first and a second sheet of material, said first and said second sheets of material having a generally rectangular shape;

said first and said second sheets of material having a plurality of large parallel welds connecting said first and second layers of material, said large welds extending nearly to the sides of said first and said second sheets of material, so as to leave an opening along each side of said first and said second sheets of material;

said first and said second sheets of material having a plurality of small parallel welds arranged perpendicular to said large welds, said small welds arranged so as to form generally evenly spaced chambers in fluid communication with each other;

said chambers having sealed walls formed by said large welds and open walls formed by said small welds, said open walls having openings to the adjacent chamber at a first end and a second end;

a second layer, said second layer comprised of a first and a second sheet of material;

said first and said second sheets of material having a generally rectangular shape;

said first and said second sheets of material having a plurality of large parallel welds connecting said first and second layers of material, said large welds extending nearly to the sides of said first and said second sheets of material, so as to leave an opening along each side of said first and said second sheets of material;

said first and said second sheets of material having a plurality of small parallel welds arranged perpendicular to said large welds, said small welds arranged so as to form evenly spaced chambers in fluid communication with each other at two openings;

said chambers having sealed walls formed by said large welds and open walls formed by said small welds, said open walls having openings to the adjacent chamber at a first end and a second end; and said first and said second layers being connected by a layer of material welded around the outer edge of said first and said second layers.

14. The inflatable pillow of claim 13, wherein at least one chamber has an opening defined therein so as to allow a fluid connection between said first and said second layers.

15. The inflatable pillow of claim 14, wherein said opening is defined in a chamber in a corner of said first and said second layers.

16. The inflatable pillow of claim 15, further comprising a valve defined in at least one chamber for inflation of said pillow.

17. The inflatable pillow of claim 16, wherein said valve is defined in one of said corner chambers.

18. The inflatable pillow of claim 17, wherein said welds are sonic welds.

19. The inflatable pillow of claim 17, wherein said welds are areas of said layers that have been melted together.

20. An inflatable pillow, said pillow comprising:

a first layer of chambers, said first layer of chambers being formed from two generally rectangular layers of material welded together along an outer edge;

said first layer of chambers including chambers that are fluidly connected to each other, defined by a plurality of large parallel welds connecting said two layers of material and a plurality of small parallel welds connecting said two layers;

said small parallel welds being defined perpendicular to said large parallel welds;

a second layer of chambers, said second layer of chambers being formed from two generally rectangular layers of material welded together along an outer edge;

said second layer of chambers having chambers that are fluidly connected to each other, defined by a plurality of large parallel welds connecting said two layers and a plurality of small parallel welds connecting said two layers; and said small parallel welds being defined perpendicular to said large parallel welds.

21. The inflatable pillow of claim 20, further comprising a connecting layer connecting said first layer of chambers to said second layer of chambers.

22. The inflatable pillow of claim 21, wherein said connecting layer is attached to the outer edge of said first and said second layers of chambers.

23. The inflatable pillow of claim 22, wherein said chambers further comprise a first type of chamber and a second type of chamber, said first type of chamber being defined in a top and a bottom outside row of said first and said second layers, said second type of chamber being defined on all other locations.

24. The inflatable pillow of claim 23, wherein said first type of chamber has at least one fluid connection to each adjacent chamber.

25. The inflatable pillow of claim 24, wherein said second type of chamber has at least one fluid connection to the chambers adjacent two opposite sides and is sealed off from the chambers on its other two opposite sides by said large welds.

26. The inflatable pillow of claim 25, wherein at least one chamber of said first and second layers of chambers has an opening defined therein to provide a fluid connection between said first and second layers of chambers.

27. The inflatable pillow of claim 26, said at least one chamber having said openings is defined in said corners of said first and said second layers of chambers.

28. The inflatable pillow of claim 27, further comprising a valve defined in at least one of said chambers of said first and second layers of chambers for inflation of said pillow.

29. The inflatable pillow of claim 28, wherein said valve is defined in at least one corner chamber.

30. The inflatable pillow of claim 29, wherein said welds are sonic welds.

* * * * *

UNITED STATES PATENT AND TRADEMARK OFFICE

CERTIFICATE OF CORRECTION

PATENT NO. : 6,973,690 B2
APPLICATION NO. : 10/196887
DATED : December 13, 2005
INVENTOR(S) : Francisco J. Muci et al.

It is certified that error appears in the above-identified patent and that said Letters Patent is hereby corrected as shown below:

On the Title Page

In column 1, item (75), delete "Francisco J. Muci, Palatine, IL (US),".

Signed and Sealed this

Twenty-second Day of May, 2007

JON W. DUDAS
*Director of the United States Patent and Trademark Office*